US006709015B1

(12) United States Patent
Vold

(10) Patent No.: US 6,709,015 B1
(45) Date of Patent: Mar. 23, 2004

(54) SKI POLE HANDLE

(75) Inventor: Per Erik Vold, Lillehammer (NO)

(73) Assignee: Swix Sport AS (NO)

( * ) Notice: Subject to any disclaimer, the term of this patent is extended or adjusted under 35 U.S.C. 154(b) by 0 days.

(21) Appl. No.: 09/868,650

(22) PCT Filed: Jan. 18, 1999

(86) PCT No.: PCT/NO00/00009

§ 371 (c)(1),
(2), (4) Date: Sep. 28, 2001

(87) PCT Pub. No.: WO00/44453

PCT Pub. Date: Aug. 3, 2000

(30) Foreign Application Priority Data

Jan. 18, 1999 (NO) ..... 19990224

(51) Int. Cl.[7] ..... A63C 11/22
(52) U.S. Cl. ..... 280/821; 16/DIG. 12
(58) Field of Search ..... 280/809, 819, 280/821, 822; 16/421, 430, 431, DIG. 12

(56) References Cited

U.S. PATENT DOCUMENTS 3,933,364 A * 1/1976 With ..... 280/821
4,244,602 A * 1/1981 Allsop et al. ..... 280/821
4,416,036 A * 11/1983 Aho ..... 280/821

FOREIGN PATENT DOCUMENTS

| | | | | |
|---|---|---|---|---|
| AT | 223985 | * | 10/1962 | ..... 280/821 |
| DE | 195 09 081 C1 | * | 6/1996 | ..... A63C/11/22 |
| DE | 19632718 | | 7/1997 | |
| EP | 0328023 | | 8/1989 | |
| FR | 2 602 432 | * | 2/1988 | ..... A63C/11/22 |
| JP | 9155002 | | 7/1997 | |

* cited by examiner

*Primary Examiner*—Frank Vanaman
(74) *Attorney, Agent, or Firm*—Bacon & Thomas, PLLC

(57) ABSTRACT

A handle for a ski pole includes an elongate handle stem and hand gripping material secured to the handle stem. The handle stem defines a head portion configured to accommodate and secure a strap thereto, and a longitudinal portion extending from below the head portion that defines opposed, elongate slots extending along at least a portion of the length thereof. The hand gripping material is secured to the longitudinal portion and engages the opposed slots.

8 Claims, 2 Drawing Sheets

7
9
1
AA
3
5
11
AA
4
12
8
6
2

SKI POLE HANDLE

BACKGROUND OF THE INVENTION

Soft liner material such as cork for use on pole handles are usually shaped for accommodation to the user's hand. Hitherto it has been common to form unitary cork handles and attach such cork handles directly to the poles. Typically, the cork handles are formed with a circular cylindrical bore and are glued directly to the upper end of the poles.

As known, cork is a material well suited for ski pole handles, due to its light weight, soft feel, and good friction and heat insulating properties.

Further it is known to use a handle top formed of plastic, which forms an attachment for a strap. The handle top is glued to the pole tube and is shaped such that smooth transitions to the cork handle are provided. The manufacture of a pole having such a handle is carried out in that the cork handle initially is threaded down on the pole tube to a preliminary position lower than that where the cork handle is to be positioned. Thereupon the handle top is glued to the upper end of the pole tube with melting adhesive. Epoxy adhesive is applied on the top portion of the pole tube and the cork handle is shifted upwardly to its final position and thereby secured by the adhesive. The use of melting adhesive on the pole tube and the handle top is not an easy process. A cork handle subjected to excessive wear or damage must be removed and is often destroyed during removal. The pole must be "cleaned" of cork material before a new handle can be fitted. This is a cumbersome and time consuming process, whereby the pole may be damaged.

In order to simplify replacement of the cork handle, it may be glued externally on a handle stem formed of plastic which surrounds the upper end of the pole tube and includes a handle top for attachment of a strap. Replacement can be performed by replacing both the handle stem and the cork handle.

For cross-country skiers, it is of importance that the pole handle has as little width as possible in the gripping area. The smallest achievable width is the diameter of the upper end of the pole tube. It is, however, desirable to have a coating of a soft liner material, such as cork, externally on the handle. The coating must have a certain minimum thickness in order to have some effect or in order not to burst. Another object is that the handle should have as low weight as possible.

SUMMARY OF THE INVENTION

The present invention provides a device which is characterized in that the stem mainly covers only forward and rearward portions along a gripping area of the handle, whereby the stem along a longitudinal portion or gripping area of the handle is defined by two elongated portions having internal surfaces adapted to the shape of the pole, and whereby two longitudinal slots or openings in the stem are defined between these portions.

Thus, the stem is shaped so that it can accommodate members of a hand gripping, soft liner material which forms the external surface of the stem in the area below a head portion of the handle. The stem has slots or openings along each side, whereby the pole tube is exposed in these openings. Thus, the liner material lies directly against the pole tube in these openings, and the width of the handle corresponds to the diameter of the pole tube in addition to twice the thickness of the liner material.

Besides cork, the liner material may be plastic, rubber or any other liner material that would be approved to one skilled in the art.

Because the stem has a non-circular exterior cross-sectional shape, the use of a unitary sleeve of cork is not desirable, because no circular bore is to be drilled therein. A bore having a non-circular cross section will have to be machined in a different manner than by drilling. In order to avoid this, two halves of liner material can be used.

Cutting of two such halves can be avoided in that, instead of common cork material, members formed by pressing and glueing together cork granules can be used. This may be performed by a process similar to sintering of metal. Such a process makes it simpler to provide cork parts having a desired shape than by cutting a solid cork workpiece.

Whether common cork material or pressed and glued cork granules are used, cork members having a desired shape can be formed and attached to the stem. It is desirable to provide two cork members, which are fitted on either side of the stem, and preferably such that the cork members adjoin each other in a dividing plane on the front and rear of the stem. The cork members may be glued to the stem in the portions where they cover it, i.e., to the exterior of the elongated portions of the stem.

Thus, the stem has a front and rear elongated portion in the gripping area of the handle, and these portions may have generally crescent-shaped cross-sectional areas. Between these portions, which form a pair of bars, the stem has a continuous, elongated opening along each side.

The invention will be explained in detail below, with reference to the accompanying drawing, showing a stem adapted to be fastened to a ski pole and fitted with a hand gripping material, soft cover in gripping area.

DESCRIPTION OF THE INVENTION

Figure 1:
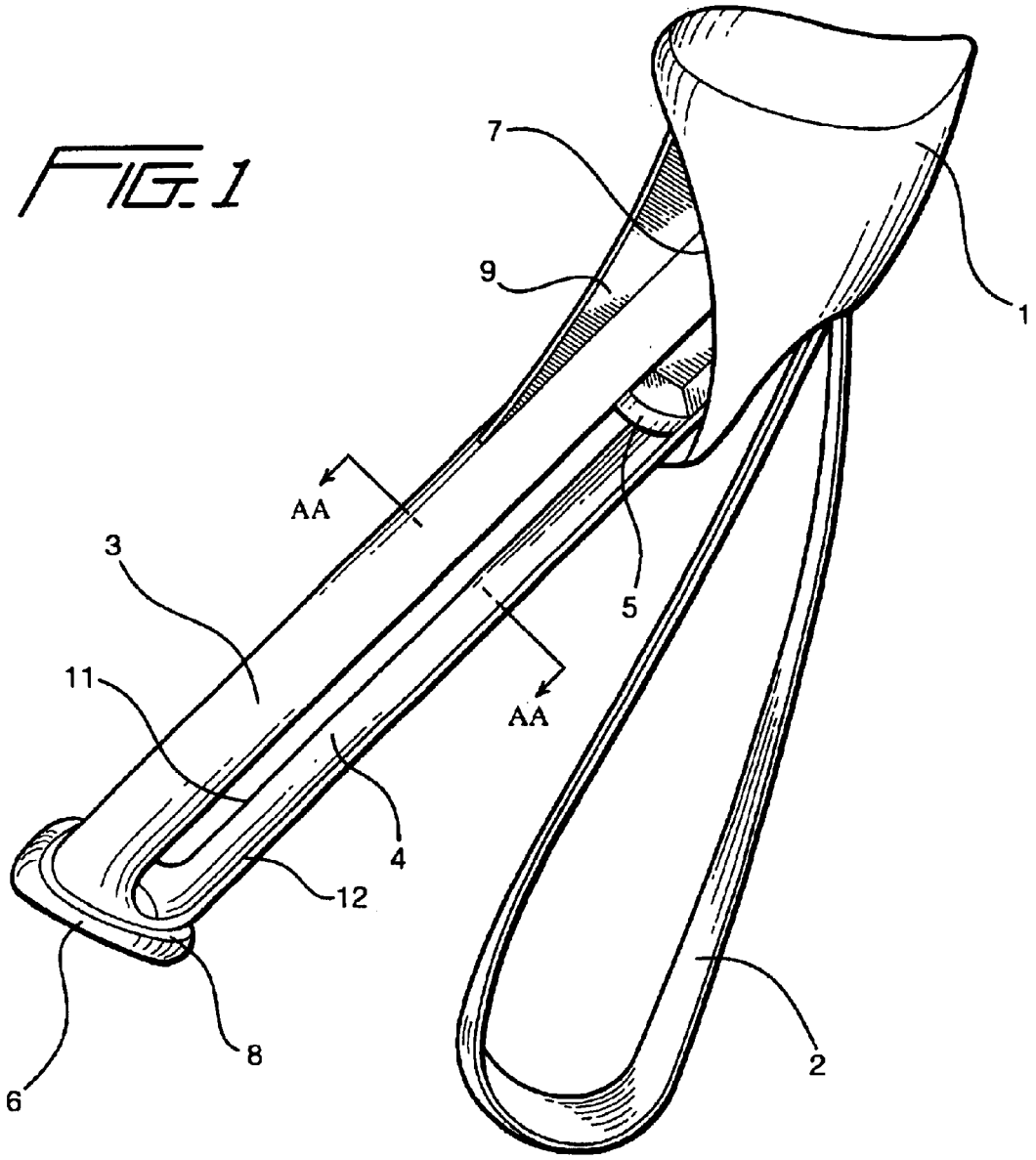
FIG. 1 shows a perspective view of a handle stem of the present invention.
Figure 2:
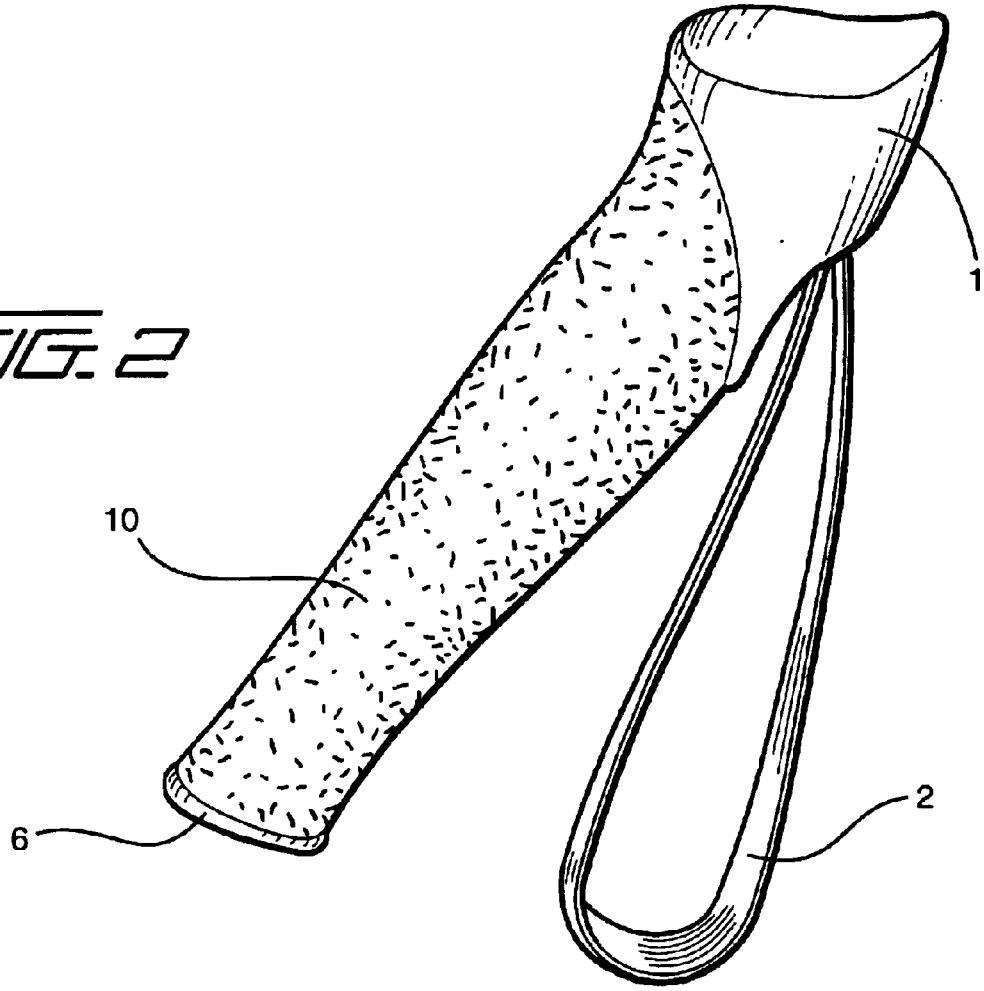
FIG. 2 is a perspective view of the handle of the present invention with hand gripping material secured to the handle stem.
Figure 3:
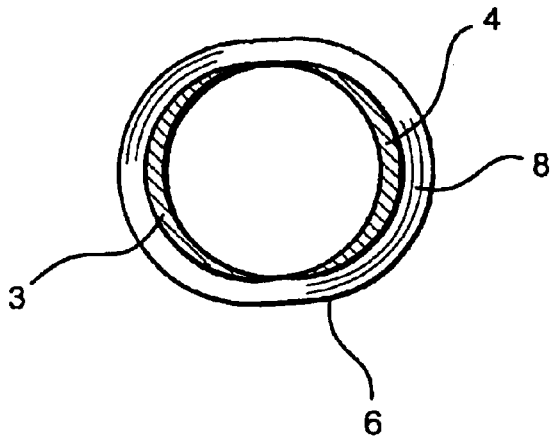
FIG. 3 is a cross-sectional view of the longitudinal portion of the handle stem taken along line AA—AA in FIG. 1.

The top of the stem has a head portion 1, to which a strap 2 can be attached. The head portion 1 may be formed with a throughgoing opening (not shown in the drawings), through which the strap 2 can be threaded from below so that the ends of the strap protrude upwardly from the head. When the strap has a suitable effective length for the user in question, the strap is locked by a wedge which is inserted in the head 1. The wedge is pressed down into the opening to be fitted therein. The strap extends down from the head 1 from the lower right part thereof, as shown in FIG. 1. For adjustment of the effective length of the strap, the wedge can be pulled up from the opening. The wedge may have spikes or ribs for locking of the strap. It will, however, be appreciated that the stem does not have to comprise a head with means for adjustment of the strap length. The strap may be permanently fastened and have a constant effective length or be adjustable by other means than a locking wedge, for instance a buckle oh the strap. Of course, another type of strap than the one shown can be used, for instance, a strap with a wide band, which may be divided and is joined by hook and loop fastener elements. The strap and the fitting thereof does not comprise anything substantial of the present invention.

The head portion 1 is in the lower part delimited by a curved edge 7, against which the cork members or hand gripping material 10 are to lie. From the head 1 extend a longitudinal portion defined by two elongated portions 3 and 4, which in the lower part pass into a somewhat oval end portion 6 delimited upwardly by an edge 8 against which the cork members 10 will be lying. Thus, elongated slots 11, 12 between the portions 3 and 4 are defined. The interior of the longitudinal portions 3 and 4 and the end portion 6 will after fitting on a pole tube be lying against the exterior of the pole tube. For correct fitting on a pole tube the stem has a transverse wall 5, being in abutment against the top of the pole tube when the stem has been pushed down on it. In order to simplify correct fitting of two cork members 10 on the stem, one elongated portion 3 has an external rib 9 integral with the had 1, and the cork members 10, having recesses for accommodating the rib, are fitted against a respective side of this rib, whereby the cork members 10 will be lying in mutual abutment outside of the rib 9. The stem is symmetrical about a middle plane through the rib 9, and the cork members 10 are mirror images of each other. The rib 9 will during use of the pole be facing in the direction of movement.

Because the elongated portions 3 and 4 delimit slots 11, 12 where the pole tube is exposed, the cork members 10 will be lying directly against he pole tube in these slots 11, 12. Thus, the elongated portions 3 and 4 form "linings" between the pole tube and the cork members 10. The elongated portions 3 and 4 may be bar shaped, have generally crescent shaped cross-sectional areas, whereby their longitudinal edges are pointed in order to form a smooth transition between the elongated portions 3 and 4 and the surface of the pole tube which is exposed in the slots 11, 12 therebetween. When the cork members 10 have an approximately constant wall thickness along most of the portions 3 and 4, the gripping portion as a whole will have an oval cross section.

It will also be appreciated that the soft liner material does not need to be cork or cork granules, but that another material having similar properties can be used.

What is claimed is:

1. A handle for a ski pole comprising:

an elongate handle stem configured and dimensioned to be secured axially to a top portion of a ski pole, said handle stem including a head portion configured to accommodate and secure a strap thereto, and a longitudinal portion extending from below the head portion axially along a ski pole, said longitudinal portion having opposed, elongate through slots extending along at least a portion of the length thereof; and hand gripping material secured to said handle stem at a position beginning below the head portion of the handle stem and substantially extending therefrom along the length of said longitudinal portion, wherein the hand gripping material engages and extends through the slots.

2. The handle according to claim 1, wherein the longitudinal portion is divided into discrete first and second opposed, solid elongated portions delimited by the slots, each portion defining a generally crescent shaped cross-sectional section with a thickness that decreases from a center portion to opposed end portions thereof.

3. The handle according to claim 1 or 2, wherein the hand gripping material comprises pressed and bonded cork granules.

4. The handle according to claim 1 or 2, wherein the handle stem includes a rib extending longitudinally from said head portion to said longitudinal portion.

5. The handle according to claim 3, wherein the handle stem includes a rib extending longitudinally from said head portion to said longitudinal portion.

6. The handle according to claim 1, further comprising a strap secured to the head portion of the handle stem.

7. The handle according to claim 1, wherein said handle includes a rearward side configured to generally face towards a user using a ski pole with the handle attached thereto and a forward side opposite the rearward side, the slots defined along lateral sides of the handle stem relative to the forward and rearward sides.

8. A handle for a ski pole comprising:

an elongate handle stem configured and dimensioned to be secured axially to a top portion of a ski pole, said handle stem including a head portion configured to accommodate and secure a strap thereto, and a longitudinal portion extending from below the head portion axially along a ski pole, said longitudinal portion having opposed, elongate through slots extending along at least a portion of the length thereof; and hand gripping material secured to said handle stem at a position beginning below the head portion of the handle stem and substantially extending therefrom along the length of said longitudinal portion, wherein the hand gripping material engages and extends through the slots and defines an inner periphery of the handle such that said hand gripping material is directly adjacent to a ski pole when the handle is provided thereon.

* * * * *

UNITED STATES PATENT AND TRADEMARK OFFICE

CERTIFICATE OF CORRECTION

PATENT NO. : 6,709,015 B1
DATED : March 23, 2004
INVENTOR(S) : Per Erik Vold

It is certified that error appears in the above-identified patent and that said Letters Patent is hereby corrected as shown below:

Title page,
Item [22], PCT Filed:, should read -- January 12, 2000 --

Signed and Sealed this

First Day of June, 2004

JON W. DUDAS
*Acting Director of the United States Patent and Trademark Office*